United States Patent [19]

Goldsmith

[11] 4,352,599

[45] Oct. 5, 1982

[54] PERMANENT MOORING OF TENSION LEG PLATFORMS

[75] Inventor: Riley G. Goldsmith, Houston, Tex.

[73] Assignee: Conoco Inc., Ponca City, Okla.

[21] Appl. No.: 175,101

[22] Filed: Aug. 4, 1980

[51] Int. Cl.[3] ..... E02B 17/00

[52] U.S. Cl. ..... 405/224; 166/341; 405/227

[58] Field of Search ..... 405/195–208, 405/224–227; 166/338–343; 175/5–10; 114/264, 265

[56] References Cited

U.S. PATENT DOCUMENTS

| | | | |
|---|---|---|---|
| 3,572,044 | 3/1971 | Paganowski . | |
| 3,611,734 | 10/1971 | Mott . | |
| 3,648,638 | 3/1972 | Blenkarn . | |
| 3,654,886 | 4/1972 | Silverman . | |
| 3,672,177 | 6/1972 | Manning | 175/9 |
| 3,788,396 | 1/1974 | Shatto et al. | 166/341 |
| 3,919,957 | 11/1975 | Ray et al. . | |
| 3,943,725 | 3/1976 | Pennock . | |
| 3,955,521 | 5/1976 | Mott . | |
| 3,976,021 | 8/1976 | Blenkarn et al. . | |
| 3,982,492 | 9/1976 | Steddum . | |
| 3,986,471 | 10/1976 | Haselton . | |
| 3,996,755 | 12/1976 | Kalinowski . | |
| 4,031,544 | 6/1977 | LaPetina | 166/341 X |
| 4,039,025 | 8/1977 | Burkhardt et al. | 166/290 |
| 4,062,313 | 12/1977 | Stram | 114/265 |
| 4,109,478 | 8/1978 | Gracia . | |
| 4,126,008 | 11/1978 | Dixon | 405/207 |
| 4,127,005 | 11/1978 | Osborne | 405/227 |
| 4,129,009 | 12/1978 | Janz | 405/227 |
| 4,169,424 | 10/1979 | Newby et al. | 405/224 X |
| 4,174,011 | 11/1979 | Zaremba | 166/341 X |
| 4,181,453 | 1/1980 | Vache | 405/203 |
| 4,226,555 | 10/1980 | Bourne et al. | 405/224 |

*Primary Examiner*—Dennis L. Taylor
*Attorney, Agent, or Firm*—A. Joe Reinert

[57] ABSTRACT

Apparatus and methods for permanently mooring a tension leg platform.

19 Claims, 12 Drawing Figures

PERMANENT MOORING OF TENSION LEG PLATFORMS

BACKGROUND OF THE INVENTION

1. Field of the Invention

This invention relates generally to the mooring of floating structures, and more particularly, but not by way of limitation, to the mooring of a floating structure utilized as an offshore oil and gas drilling and production platform.

2. Description of the Prior Art

As offshore exploration for oil and gas from subsea deposits has expanded into deeper and deeper waters, conventional rigid towers setting upon the ocean floor and extending upward to the surface have become more and more impractical.

One particular solution to this problem is the elimination of the rigid tower and the substitution therefor of a floating platform moored to the ocean floor by a plurality of vertical members which are placed under high tension loads due to excess buoyancy of the floating platform. Examples of such structures, which are generally referred to as tension leg platforms, are shown in U.S. Pat. Nos. 3,648,638 to Blenkarn and U.S. Pat. No. 3,919,957 to Ray, et al.

One particular problem which must be overcome with any design of tension leg platform is the manner in which the floating platform is attached to the subsea anchor, i.e. the manner of mooring. Particularly, when locating the platform in deep waters where severe environmental conditions are often present, such as for example in the North Sea, it is desirable that the actual mooring of the platform be accomplished in a relatively short time, e.g. a matter of hours, and that it be accomplished without the need for the use of divers.

One manner of achieving these ends is suggested by U.S. Pat. Nos. 3,919,957 to Ray, et al. and 3,982,492 to Steddum. Both of those references, which disclose substantially the same structure, use dead weight anchors which are lowered from the floating platform to the ocean floor by the vertical tethering elements. Those references also disclose thrusting devices 32 attached to the floating structure.

Another system is proposed in U.S. Pat. No. 3,976,021 to Blenkarn et al. and in U.S. Pat. No. 4,062,313 to Stram, wherein a gravity base is lowered on temporary mooring cables from the floating platform and is then attached to the ocean floor by a plurality of piles. Then the permanent tethering elements are lowered from the floating platform and attached to the anchors. The path of the permanent tethering elements as they are lowered into engagement with the anchors is defined by a plurality of guide members, having guide openings 82 such as shown in FIG. 12 of Blenkarn et al., and vertical guide passages 41 located upon the anchor as shown in FIG. 9 of Blenkarn et al. Both of the openings 82 and 41 of Blenkarn et al. include upwardly opening funnel shaped portions. The platform of Blenkarn et al. is moved into place with tug boats. After the risers are connected, the temporary mooring cables are released.

Yet another manner of solving the problem of connecting the permanent tethering elements between the anchor and the floating platform is to manufacture the permanent tethering elements integrally with the platform and then attach the tethering elements and the platform to the anchor in one step as is disclosed in U.S. Pat. No. 3,611,734 to Mott.

In U.S. Pat. No. 3,955,521 to Mott, individual tethering elements are lowered into engagement with pre-set anchor piles.

U.S. Pat. No. 4,181,453 to Vache suggests at column 2, lines 51–56, the use of television cameras attached to the floating platform to view reference markers located upon the ocean floor and thereby aid in positioning the floating platform.

The prior art includes underwater television cameras and remote controlled vehicles carrying such cameras.

The use of a jet thruster attached to a rotatable drill string to vary the lateral location of a drill string is included in the prior art and has been used for example on the drilling ship, Glomar Challenger.

Other references relating generally to tension leg platforms and/or the lowering of anchors or other objects from floating structures, but not believed to be any more relevant than the references discussed in more detail above, include:

| U.S. Pat. No. | Patentee |
|---|---|
| 4,126,008 | Dixon |
| 4,169,424 | Newby, et al. |
| 4,129,009 | Jansz |
| 4,127,005 | Osborne |
| 3,996,755 | Kalinowski |
| 3,986,471 | Haselton |
| 3,943,725 | Pennock |
| 3,654,886 | Silverman |
| 3,572,044 | Pogonowski |
| 4,109,478 | Gracia |
| 3,672,177 | Manning |
| 4,039,025 | Burkhardt, et al. |

SUMMARY OF THE INVENTION

Methods and apparatus are provided for permanently mooring a tension leg platform. An upward opening guide funnel is provided on an anchor attached to the ocean floor. The platform is temporarily moored to the anchor by a plurality of substantially vertical temporary mooring lines held in tension by a buoyancy of the platform. A permanent tethering element is lowered from the platform, while the platform is temporarily moored, until a lower end thereof is located a relatively short distance above the anchor.

An underwater television camera is used to observe the position of the lower end of the permanent tethering element relative to the guide funnel. Th lower end of the tethering element is moved laterally as necessary to position it above the guide funnel, and then it is stabbed into the guide funnel and connected to the anchor.

It is, therefore, an object of the present invention to provide improved apparatus and methods for permanently mooring a floating structure.

Another object of the present invention is the provision of apparatus and methods for permanently mooring a floating structure by the use of underwater television cameras and means for laterally moving a tethering element to position it for connection to an anchor.

Yet another object of the present invention is the provision of improved apparatus and methods for permanently mooring a floating structure while it is temporarily moored with a plurality of vertical temporary mooring lines held in tension by the buoyancy of the platform.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
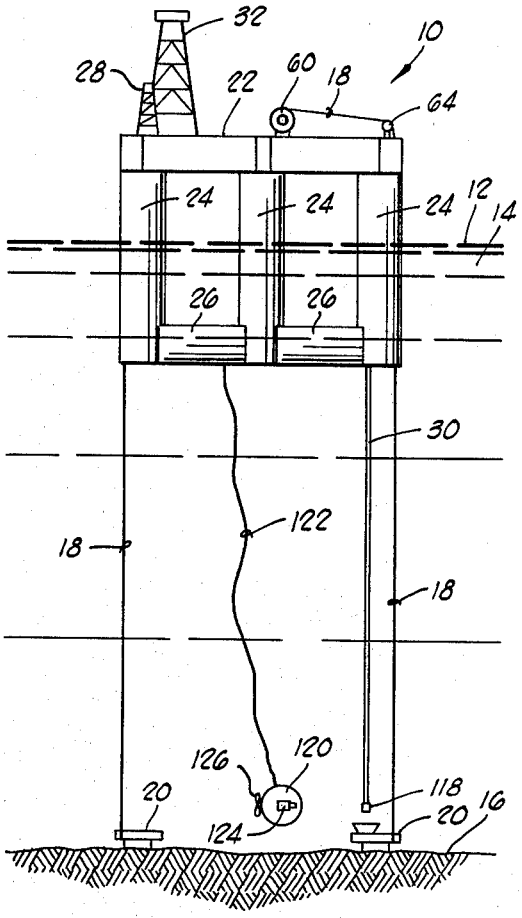
FIG. 1 is a schematic elevation view of a tension leg platform temporarily moored to the ocean floor.

Referring now to the drawings, and particularly to FIG. 1, a tension leg platform, which may be referred to as a floating structure, is generally designated by the numeral 10. The tension leg platform 10 is shown floating on a surface 12 of a body of water 14, and is temporarily moored to a floor 16 of the body of water 14 by a plurality of temporary mooring lines 18 connected to a plurality of separate anchor assemblies 20.

The manner of construction and installation of the anchor assemblies 20 is disclosed in detail in the U.S. patent application of Riley G. Goldsmith, entitled "Multiple Anchors for a Tension Leg Platform", filed concurrently herewith and assigned to the assignee of the present invention. The tension leg platform 10 includes a work deck 22 supported by a buoyant structure including vertical column members 24 and horizontal pontoon members 26.

Located above each of the four corner columns 24 is an auxiliary derrick 28 which provides a means for lowering permanent tethering elements, such as the one designated by the numeral 30 in FIG. 1, through the corner columns 24. It will be understood that FIG. 1 is schematic only and that there are four auxiliary derricks 28, one located above each of the corner columns 24.

Also located upon work deck 22 is main derrick 32 which provides a means for performing drilling and production operations.

Figure 2:
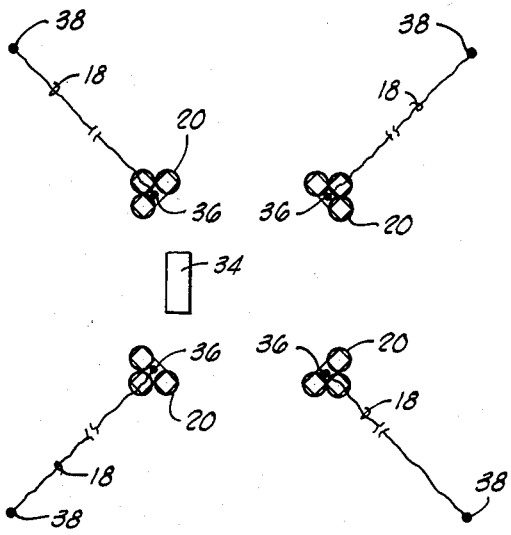
FIG. 2 is a schematic plan view of a plurality of temporary mooring lines laid in a spread pattern upon the ocean floor.

Referring now to FIG. 2, a plan view is thereshown of four anchor assemblies 20 located upon the ocean floor 16 in a predetermined pattern relative to a drilling template 34. The drilling template 34 and anchor assemblies 20 are positioned upon the ocean floor 16 prior to the use of the apparatus and method of the present invention for temporarily mooring the tension leg platform 10 to those anchors 20.

FIG. 2 shows four temporary mooring lines 18, each of which has its first end 36 connected to one of the anchor assemblies 20. The temporary mooring lines are laid in a spread pattern upon the ocean floor 16. By "spread" pattern, it is meant that each of the temporary mooring lines 18 extends outward from its anchor assembly 20 so that second ends 38 of the temporary mooring lines 18 are spaced from each other.

Figure 3:
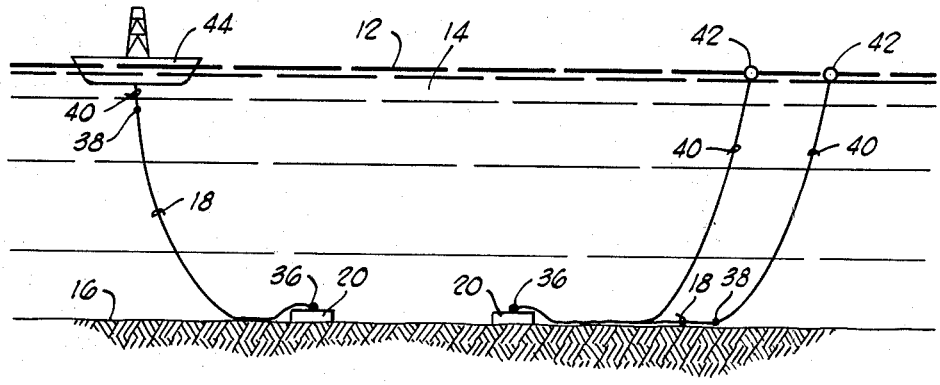
FIG. 3 is a schematic elevation view of a conventional drilling ship laying the temporary mooring lines with pendant lines attached thereto.

As can be seen in FIG. 3, a plurality of pendant lines 40, each of which includes a marker buoy 42, are connected to the second ends 38 of the temporary mooring lines 18.

The left hand side of FIG. 3 illustrates one of the temporary mooring lines 18, with a pendant line 40 attached thereto, being laid upon the ocean floor 16 by second floating structure 44 which is preferably a conventional drilling ship or the like.

It will be understood that the temporary mooring lines 18 may be attached to the pendant lines 40 prior to the lowering of the temporary mooring lines 18 from the drilling ship 44 and prior to the attachment of the lower ends 36 of temporary mooring lines 18 to the anchor means 20.

Figure 9:
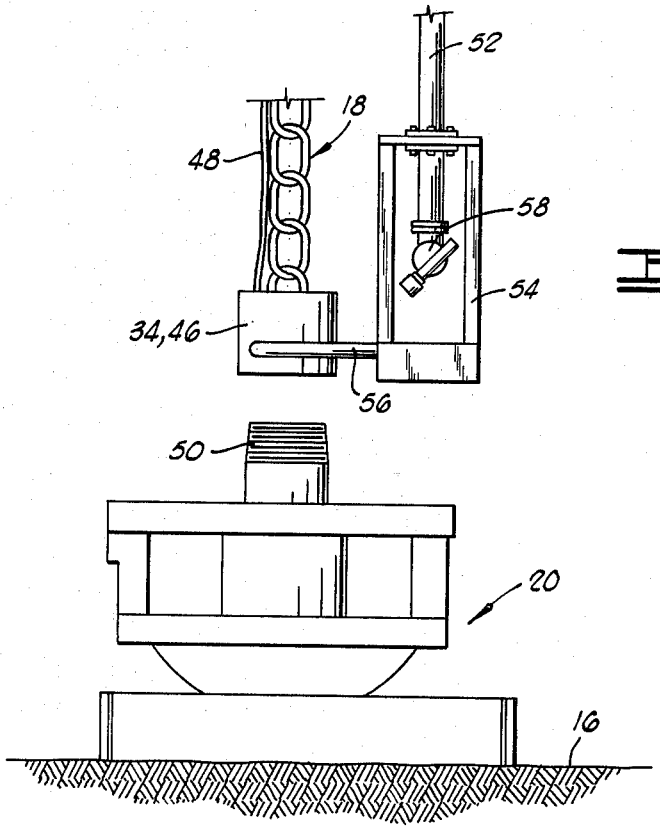
FIG. 9 is a schematic elevation view showing the manner in which a temporary mooring line is attached to an anchor assembly.

The manner in which the temporary mooring lines 18 are attached to the anchor assemblies 20 is best illustrated in FIG. 9.

The temporary mooring lines 18 are preferably constructed from four or five-inch link chain having a conventional hydraulic actuated well head connector 46 attached to a lower end thereof. The well head connector 46 is actuated by a hydraulic signal transmitted by means of hydraulic lines 48.

The anchor assembly 20 includes a standard well head type connection 50 for attachment to the well head connector 46.

The temporary mooring line 18 is lowered by means of a drill string 52 from the drilling ship 44. The drill string 52 has a cage 54 attached to a lower end thereof, which cage includes a bracket means 56 for supporting the lower end 36 of temporary mooring line 18. Cage 54 has an underwater television camera 58 disposed therein for observing the connection of temporary mooring line 18 to the anchor assembly 20.

Figure 10:
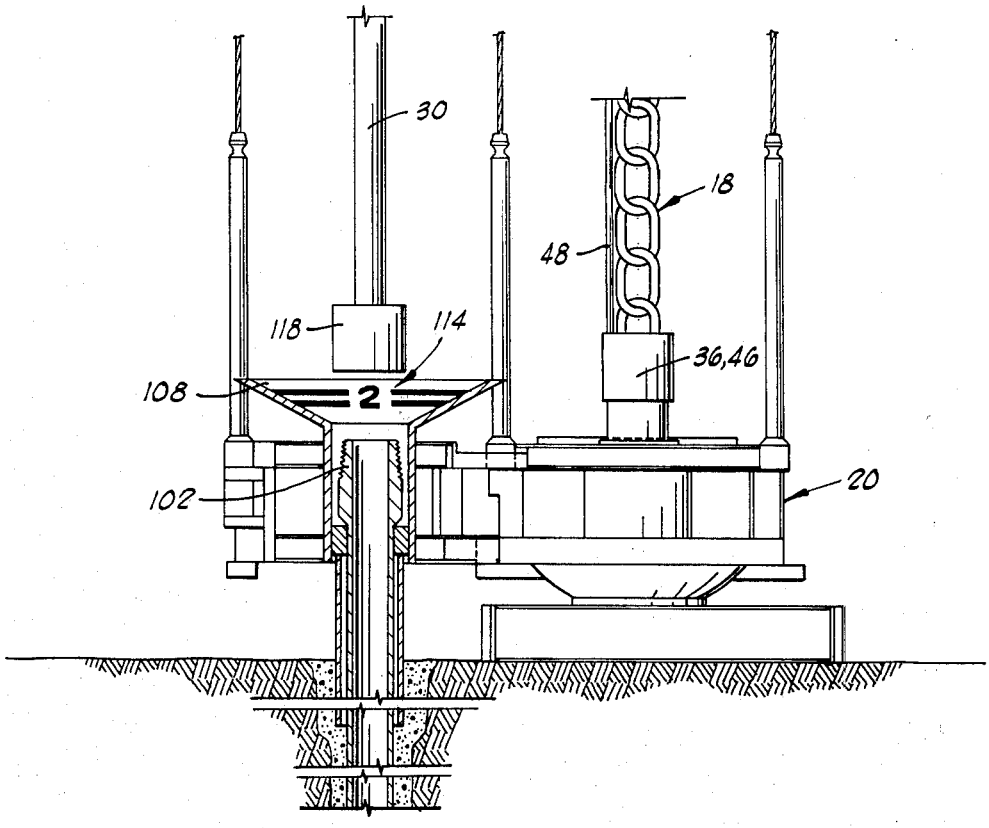
FIG. 10 is a schematic elevation view showing the manner in which a permanent tethering element is attached to an anchor assembly.

The right hand side of FIG. 10 illustrates the temporary mooring line 18 attached to the anchor assembly 20.

After all of the temporary mooring lines 18 have been attached to anchor assemblies 20 and laid upon the ocean floor as shown in FIG. 2, with pendant lines 40 and marker buoys 42 attached thereto as shown in FIG. 3, the system is ready for the arrival of the tension leg platform 10 and the attachment of the tension leg platform 10 to the temporary mooring lines 18. This is accomplished as follows.

The tension leg platform 10 is moved to a position sufficiently close to a position directly above anchor means 20 so that the pendant lines 40 may be connected to the tension leg platform 10. Then the pendant lines 40 are attached to a plurality of retrieval means 60 which are located upon the tension leg platform 10.

Figure 4:
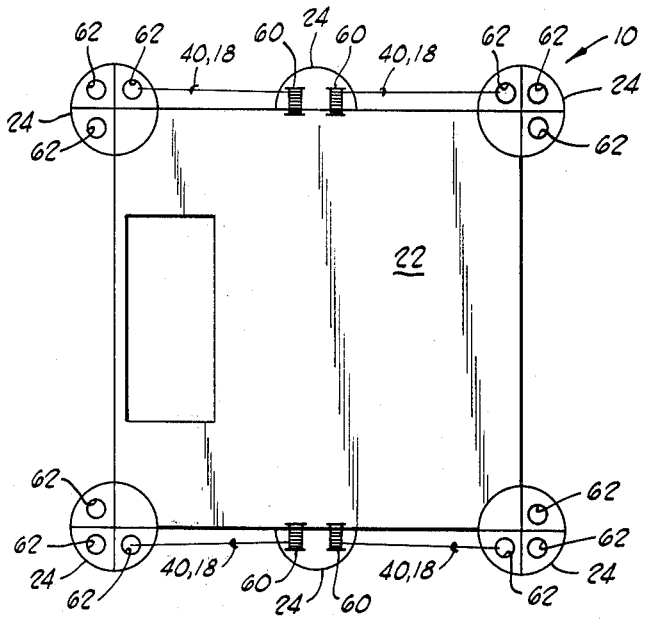
FIG. 4 is a schematic plan view of the work deck of the tension leg platform of FIG. 1, showing winches used for retrieving the pendant lines and temporary mooring lines.

As is best shown in FIG. 4, which is a schematic plan view of the work deck 22 of tension leg platform 10, the retrieval means 60 preferably includes four separate winches 60. Each of the winches 60 includes a conventional drum portion for winding one of pendant lines 40 thereon, and a conventional windlass portion for retrieving one of the mooring lines 18. A chain locker is located below the windlass for receiving the mooring line 18 which is a link chain.

Of the vertical column members 24 of tension leg platform 10, there are four of the vertical column members located at the corners of work deck 22 which may be referred to as corner column members 24. Each of those corner column members includes three hause pipes 62 which extend vertically therethrough so that a permanent tethering element 30 may be lowered through each of the hause pipes 62.

When the marker buoys 42 are retrieved, the pendant lines 40 are placed through one of the hause pipes 62 of each of the corner columns 24 and the pendant lines 40 are then attached to the winches 60.

The view shown in FIG. 4 may be considered to show either the pendant lines 40 or the temporary mooring lines 18 attached to each of the winches 60, and this is indicated by the use of double designations 40, 18 on each of the lines attached to the winches 60.

The winches 60 are actuated to retrieve the pendant lines 40 and a portion of each of the temporary mooring lines 18 onto the winches 60 of the tension leg platform 10 until the tension leg platform 10 is located approximately at a position directly above the anchor means 20, such as is shown in FIG. 1.

Then the temporary mooring lines 18 are tensioned so that a tension load on each of said temporary mooring lines 18 is greater than a magnitude of cyclic forces exerted on each of said temporary mooring lines 18, thereby preventing any snap loads on the temporary mooring lines 18 which would otherwise occur upon the temporary mooring lines 18 becoming slack.

Such cyclic loads would be imposed by the undulating motion of the tension leg platform 10 due to waves and the like acting thereupon.

Before describing the manner in which the temporary mooring lines 18 are tensioned, it is noted that the connecting of the temporary mooring lines 18 to anchor means 20, connecting of pendant lines 40 to temporary mooring lines 18, and connecting of pendant lines 40 to retrieval means 60 may be accomplished without the second vessel 44, although the method described above using second vessel 44 is preferred. For example, a temporary mooring line 18 could be lowered from the main derrick 32 of platform 10 into engagement with anchor means 20. Then, while the temporary mooring line 18 is supported from main derrick 32, one of the pendant lines 40 could be lowered from one of the auxilliary derricks 28 through one of the hause pipes 62, and its lower end could be attached to the mooring line 18 at connection 38. Then the temporary mooring line 18 is released from main derrick 32, and the pendant line 40 and temporary mooring line 18 are retrieved through the hause pipe 62 on one of the winch means 60.

The tensioning of the temporary mooring lines 18 may be accomplished in several different ways.

Figure 5:
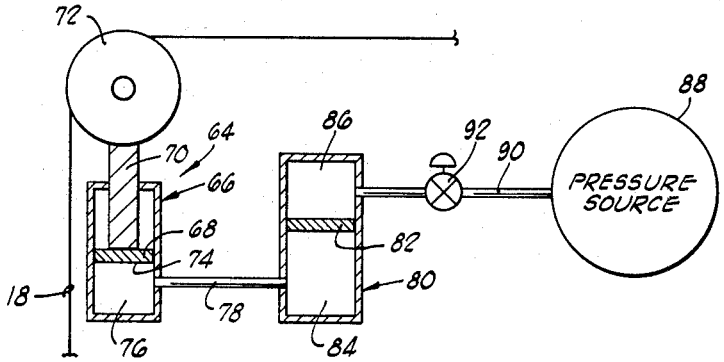
FIG. 5 is a schematic illustration of a heave compensator utilized with the temporary mooring lines.

One manner of tensioning the temporary mooring lines 18 is by the use of a heave compensator 64 engaged with each of the temporary mooring lines 18. Such a heave compensator 64 is shown schematically in FIG. 5 and the position of the heave compensator 64 is also illustrated in FIG. 1.

The heave compensator 64 includes a hydraulic cylinder 66 having a piston 68 reciprocably disposed therein. A rod 70 is attached to piston 68 and has a guide sheave 72 rotatingly attached thereto. The temporary mooring line 18 engages guide sheave 72.

A constant hydraulic pressure is applied to a lower surface 74 of piston 66 from a pressure chamber 76 defined within cylinder 66 below piston 68. Constant pressure hydraulic fluid is supplied to the chamber 76 through a conduit 78 from a pressure transfer cylinder 80.

Disposed within pressure transfer cylinder 80 is a floating piston 82 which divides pressure transfer cylinder 80 into a hydraulic fluid chamber 84 and a primary pressure chamber 86.

The primary pressure chamber 86 is connected to a pressure source 88 by conduit 90 which has a pressure regulator 92 disposed therein.

The pressure source 88 is preferably a source of gas under pressure, and the pressure regulator 92 provides a means for regulating the pressure of the gas within the primary pressure chamber 86 of pressure transfer cylinder 80. The pressure of the gas within primary pressure chamber 86 is transmitted to the hydraulic fluid in hydraulic pressure chamber 84 by the floating piston 82. This provides a means for applying a constant hydraulic pressure to the piston 68 of cylinder 66 of heave compensator 64, and for varying that constant hydraulic pressure to increase or decrease the same to correspondingly increase or decrease the tension applied to the temporary mooring line 18 by the heave compensator 64.

Another method of tensioning the temporary mooring lines 18 is to lock each of the temporary mooring lines 18 to the tension leg platform 10 with a conventional chainstopper (not shown) to fix the length thereof, and then to deballast the tension leg platform 10 in a manner well known to those skilled in the art, to increase the buoyancy thereof and thereby increase the tension applied to the temporary mooring lines 18.

Yet another manner of tensioning the temporary mooring lines 18 is to construct the winches 60 of sufficient capacity so that they may apply the desired tension to the temporary mooring lines 18.

Another problem which is sometimes encountered, while connecting the temporary mooring lines 18 to the tension leg platform 10, is that wave motion acting upon the tension leg platform 10 causes the tension leg platform 10 to undulate thereby possibly applying snap loads to temporary mooring lines 18 before they can be tensioned in one of the manners just described above.

A solution to this problem is provided by applying a horizontal force to the tension leg platform 10 to move it horizontally away from the position directly above the anchor means 20 by a distance sufficient to apply a temporary tension load to each of the temporary mooring lines 18 great enough to prevent snap loads from being imposed upon the temporary mooring lines 18 due to the cyclical forces of the waves acting upon the tension leg platform 10. This horizontal force is preferably applied to the tension leg platform 10 by the use of a conventional tug boat. Then, the temporary mooring lines 18 may be permanently tensioned in one of the three manners described above, or in a similar manner, while the horizontal force is maintained upon the tension leg platform 10 by the tug boat. In that manner the permanent tensioning can be accomplished without allowing any snap loads to be applied to the temporary mooring lines 18 during the permanent tensioning.

Figure 6:
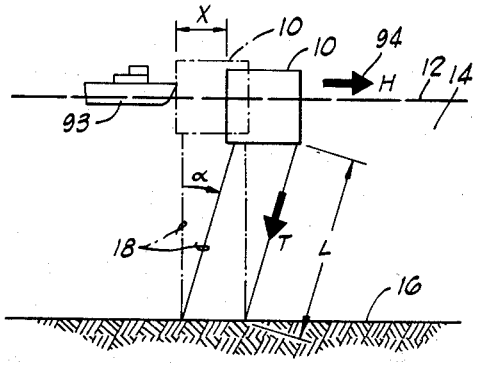
FIG. 6 is a schematic illustration, corresponding to Table 1 of the disclosure, which relates to horizontal forces required to displace the tension leg platform from a position directly above the anchor means.
Figure 7:
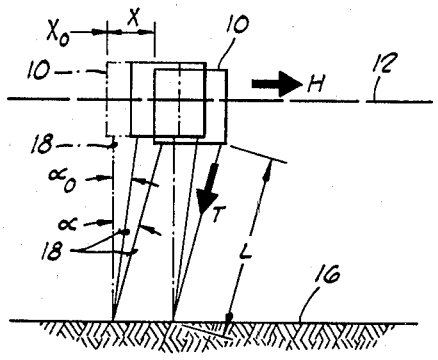
FIG. 7 is a view similar to FIG. 6, and corresponding to Table 2, which relates to horizontal forces required to displace the tension leg platform when the temporary mooring cables have a length longer than a desired length thereof.

The feasibility of such temporary tensioning can be appreciated in view of the following analysis with respect to FIGS. 6 and 7.

FIG. 6 illustrates schematically the forces acting upon tension leg platform 10 when a horizontal force H is applied thereto. A tugboat 93 is schematically illustrated as applying the force H. Horizontal forces may also be present due to tides, wide currents and the like. The non-displaced position of the tension leg platform 10 is shown in phantom lines, and the displaced position of tension leg platform 10 is shown in solid lines, with the platform 10 displaced through a distance X due to the horizontal force H represented by the vector 94.

For a given excess buoyancy $T_o$ of O, 250, 500, 750 or 1000 tonnes, the horizontal force H required to achieve offset X of 10, 20, 30, 40 or 50 feet is shown in the following Table 1.

TABLE 1

| | To, tonnes | H, tonnes, for | | | |
|---|---|---|---|---|---|
| X, ft. | 0 | 250 | 500 | 750 | 1000 |
| 10 | 1.3 | 8.0 | 14.7 | 21.4 | 28.1 |
| 20 | 10.0 | 23.4 | 36.9 | 50.3 | 63.8 |
| 30 | 33.6 | 53.8 | 73.9 | 94.1 | 114.2 |
| 40 | 79.3 | 106.2 | 133.1 | 159.9 | 186.8 |
| 50 | 154.2 | 187.8 | 221.4 | 255.0 | 288.6 |

Table 1 was prepared from the following analysis of the forces illustrated in FIG. 6. By summing the horizontal and vertical forces acting upon the tension leg platform 10, the following equations 1 and 2, respectively, are obtained.

$$T\sin\alpha = H \quad (1)$$

$$T\cos\alpha = T_o + L(l-\cos\alpha)\gamma A_{wp} \quad (2)$$

where:

$\alpha = \tan^{-1}x/L$ $T_o$ = excess buoyancy $A_{wp}$ = water plane area $\gamma$ = specific weight of sea water (1.026 tonnes/m$^3$)

L = 372 ft.

The angle by which the temporary mooring lines 18 are displaced from a vertical position is represented by the symbol $\alpha$. The excess buoyancy $T_o$, is the weight of water displaced by the tension leg platform 10 in excess of the weight of the tension leg platform 10. The water plane area, $A_{wp}$, is the horizontal area of the tension leg platform 10 at an imaginary horizontal section therethrough at the surface 12 of the body of water 14. The specific weight of sea water is represented by the symbol $\gamma$. The length of the temporary mooring lines 18 for the specific embodiment of tension leg platform 10 for which the calculations and tables 1 and 2 were made, which was based on a design specifically made for use in the Hutton field of the North Sea where the water depth is 485 feet, is given as 372 feet. The forces listed in Tables 1 and 2 are in metric tonnes.

Similarly, FIG. 7 schematically represents the forces acting upon tension leg platform 10 when the temporary mooring lines 18 are ten feet longer than the desired length. This illustrates the horizontal forces required to pre-tension the temporary mooring lines 18 when the tension leg platform 10 is initially located approximately above the anchor means 20, but not exactly directly above the anchor means 20. It will be understood that the analysis and discussion with regard to FIG. 7 is merely by way of example to illustrate the forces required to pre-tension the temporary mooring lines 18 with a less than perfect initial positioning of the platform 10. These figures are given because it is very possible that the initial positioning of the tension leg platform 10 prior to the permanent tension of the temporary mooring lines 18 will be such that there will be some slight initial offset.

The horizontal forces, H, for the situation illustrated in FIG. 7, are given in the following Table 2.

TABLE 2

| | To, tonnes | H, tonnes, for | | | |
|---|---|---|---|---|---|
| X, ft. | 0 | 250 | 500 | 750 | 1000 |
| $X_o$ | 0 | 56.8 | 113.7 | 170.5 | 227.3 |
| $X_o$ + 10 | 193.7 | 257.1 | 320.4 | 383.8 | 447.2 |
| 20 | 446.3 | 516.2 | 586.1 | 656.0 | 726.0 |
| 30 | 761.9 | 838.4 | 914.8 | 991.3 | 1067.7 |
| 40 | 1143.9 | 1226.9 | 1309.9 | 1392.9 | 1475.9 |

The data in Table 2 is obtained from FIG. 7 by the following analysis. Horizontal and vertical forces acting upon the tension leg platform 10 are summed to given the following equations 3 and 4, respectively:

$$T\sin\alpha = H \quad (3)$$

$$T\cos\alpha = T_o + L(\cos\alpha_o - \cos\alpha)\gamma A_{wp} \quad (4)$$

where:

$\alpha = \tan^{-1}x/L$ $T_o$ = excess buoyancy $A_{wp}$ = water plane area $\gamma$ = specific wt of sea water (1.026 tonnes/m$^3$)

L = 382 ft

The initial offset required to straighten the temporary mooring lines 18 is represented by the designation $X_o$ and is obtained in the following manner:

$$X_o = \sqrt{(382)^2 - (372)^2}$$

$$= 86.83 \text{ ft}$$

The initial angle of the temporary mooring lines 18 from the vertical is designated as $\alpha_o$.

These number given in Tables 1 and 2 illustrate the feasibility of utilizing conventional tug boats to achieve this pre-tensioning of the temporary mooring lines 18. Tug boats such as generally used in the North Sea can produce on the order of 50 to 100 metric tonnes of thrust.

The numbers from Tables 1 and 2 illustrate the horizontal force H required to achieve a given horizontal displacement X in feet as shown in the left hand column of the tables, for a given excess buoyancy $T_o$ listed in the top row of each table. The pre-tension force T in the temporary mooring lines 18 corresponding to the horizontal displacement X may be determined by the relationships given with regard to FIGS. 6 and 7.

For any desired pre-tension T, the corresponding offset X may be determined from Equation 2 for FIG. 6 and Equation 4 for FIG. 7, and the known relationship between X and $\alpha$. That value of X may be used to enter Table 1 or 2, and depending upon the value of To for the specific platform under consideration the value of H is shown in the tables.

These values of H, particularly as shown in Table 1 where there is no offset of the platform, are generally on the same order of magnitude as the thrust which may be provided by a typical North Sea tugboat, e.g. 50 to 100 tonnes, so that it is feasible to supply the necessary horizontal force 14 by the use of a reasonable number of tugboats.

After all four of the temporary mooring lines have been connected between the tension leg platform 10 and the separate anchors 20, the tension leg platform 10 may be permanently moored by attaching a plurality of permanent vertical mooring elements, such as 30, between the tension leg platform 10 and the anchors 20 while the tension leg platform 10 is temporarily moored. This is preferably accomplished in the following manner.

The following method is particularly useful with a plurality of separate anchor assemblies 20 as disclosed herein, because it provides a means for maneuvering the permanent tethering elements 30 as they are lowered into engagement with the anchor assemblies 20. This is desirable because of inherent inaccuracies in the positioning of the anchor assemblies 20 upon the ocean floor 16.

Figure 8:
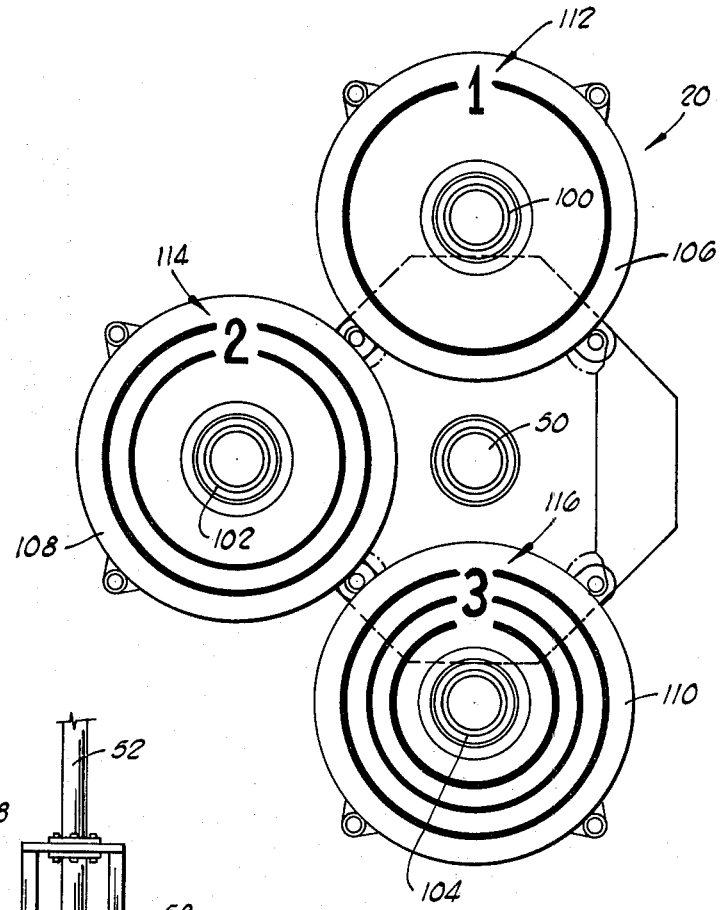
FIG. 8 is a plan view of one of the anchor assemblies to which the tension leg platform is anchored.

Referring now to FIG. 8, a plan view is thereshown of one of the anchor assemblies 20.

The anchor assembly 20 includes three separate connector means 100, 102 and 104, for connecting three of the permanent tethering elements 30 to the anchor 20.

Located above the connector means 100, 102 and 104 are a plurality of upward opening funnel shaped guide means 106, 108 and 110, respectively.

Each of the guide means 106, 108 and 110 are provided with label indicia means 112, 114 and 116, respectively, so that a proper one of said guide funnels to be engaged by a given one of the permanent vertical tethering elements 30 may be determined by visually observing the guide funnels. For example, the indicia means 112 of guide funnel 106 includes the number 1 and a single stripe encircling the connector means 100. Similarly, indicia means 114 includes the numeral 2 and two stripes.

The permanent vertical tethering elements 30 are lowered from the tension leg platform 10, as is shown in FIGS. 1 and 10, until a lower end 118 of the tethering element 30 is located a relatively short distance above the anchor means 20.

An underwater television camera is then used to observe the location of the lower end 118 of permanent vertical tethering element 30 relative to the appropriate one of the guide funnels above the appropriate connector means to which it is to be attached. For example, referring to FIG. 10, if the tethering element 30 thereshown is desired to be connected to the connector 102, the tethering element 30 should be located above the guide funnel 108.

The television camera may be located in one of two places. FIG. 1 illustrates a remote controlled vehicle 120 which is connected to the tension leg platform 10 by a command cable 122 and within which is disposed a television camera 124. The location of the remote control vehicle 120 within the body of water 114 is controlled by a plurality of thrusting propellers such as 126 which operate in response to signals conveyed down the cable 122.

Figure 12:
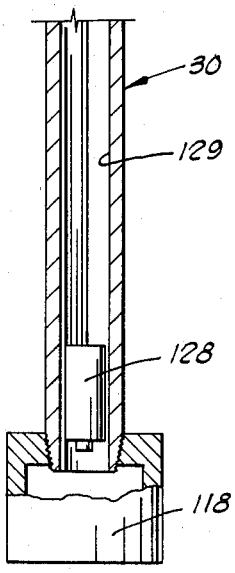
FIG. 12 is a schematic elevation view of a permanent tethering element having a television camera located in an inner passage thereof.

An alternative is shown in FIG. 12, where a television camera 128 is disposed in an inner passageway 129 of the permanent vertical tethering element 30 so that the television camera 128 looks downward below the tethering element 30. The camera 128 may be retrieved after the tethering element 30 is installed.

By either of these means, the location of the lower end 118 of the permanent vertical tethering element relative to the anchor assemblies 20 may be observed.

Then, if necessary, the lower end 118 of the tethering element 30 may be moved to a position directly above the guide funnel above the connector to which it is to be attached. This can be accomplished by either maneuvering the tension let platform 10 by applying a lateral force thereto with one or more tug boats, or by rotating the tethering element 30 until a thrusting means 130 thereof is properly directed for moving the lower end 118 in a direction toward a position directly above the guide funnel to which it is desirably attached.

Figure 11:
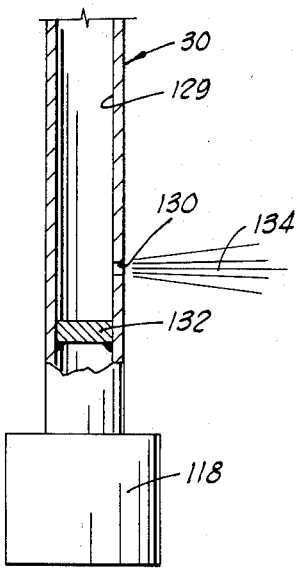
FIG. 11 is a schematic elevation view of a jet thruster means incorporated in a permanent tethering element.

Such a thrusting means 130 is schematically illustrated in FIG. 11. FIG. 11 illustrates a permanent vertical tethering element 30 with a portion thereof cut away to reveal a plug 132 sealing the inner passageway 129 below the thrusting means 130. The thrust means 130 is actuated by pumping a liquid down the inner passage 129 and out the thrust means 130, which is merely a radially directed orifice, as indicated by the jet of fluid 134. The rotation of the tethering element 30 may be accomplished manually if the tethering element is suspended from derrick 28 on a swivel.

When using the embodiment of FIG. 11 with the thruster means 130, it is necessary to use the remove controlled vehicle 120 and its camera 124, rather than a camera disposed within the tethering element 30 as shown in FIG. 12.

The lower end 118 of the permanent vertical tethering element 30 is prefereably a standard hydraulically actuated wellhead type connector, and the connector means 110, 102 and 104 are each preferably a standard wellhead.

The final connection is made by stabbing the lower end 118 of the permanent vertical tethering element 30 into the guide funnel 108. The guide funnel 108 guides the lower end 118 of the permanent vertical tethering element 30 into engagement with the connector means 102 and the connection therebetween is accomplished by the conventional hydraulic actuator.

Thus, it is seen that the methods and apparatus of the present invention for permanent mooring of a tension leg platform are readily adapted to achieve the ends and advantages mentioned as well as those inherent therein. While presently preferred embodiments of the invention have been illustrated for the purpose of this disclosure, numerous changes in the construction and arrangement of parts may be made by those skilled in the art, which changes are embodied within the scope and spirit of this invention as defined by the appended claims.

The embodiments of the invention in which an exclusive property or privilege is claimed are defined as follows:

1. A method of installing a permanent vertical tethering element between a floating structure and an anchor means, said method comprising steps of:

providing on said anchor means an upward opening guide funnel located above a connector means for connecting a lower end of said permanent vertical tethering element to said anchor means;

temporarily mooring said floating structure to said anchor means with a plurality of substantially vertical temporary mooring lines held in tension by a buoyancy of said platform;

while said floating structure is temporarily moored, lowering said permanent vertical tethering element from said floating structure until said lower end thereof is located a relatively short distance above said anchor means;

observing, with an underwater television camera, a location of said lower end of said permanent vertical tethering element relative to said guide funnel of said anchor means;

moving said lower end of said permanent vertical tethering element laterally as necessary to position it above said guide funnel;

stabbing said lower end of said permanent vertical tethering element into said guide funnel;

guiding, by means of said guide funnel, said lower end of said permanent vertical tethering element into engagement with said connector means; and connecting said lower end of said permanent vertical tethering element to said connector means.

2. The method of claim 1, wherein:

said moving step includes a step of maneuvering said floating structure to thereby move said lower end of said permanent vertical tethering element.

3. The method of claim 2, wherein:

said manuvering step includes a step of applying a lateral force to said floating structure with a tugboat.

4. The method of claim 3, wherein:

said maneuvering step further includes a step of applying an additional lateral force to said floating structure with a second tugboat.

5. The method of claim 1, wherein said moving step includes steps of:

rotating said permanent vertical tethering element until a thrusting means connected thereto is properly directed for moving said lower end of said permanent vertical tethering element in a direction toward a position above said guide funnel; and actuating said thrusting means and thereby applying a lateral force to said permanent vertical tethering element sufficient to move said lower end thereof to said position above said guide funnel.

6. The method of claim 1, wherein:

said observing step includes a step of locating said television camera within an inner passage of said permanent vertical tethering element.

7. The method of claim 6, further comprising a step of:

retrieving said television camera after said connecting step.

8. The method of claim 1, wherein:

said observing step includes steps of locating said television camera upon a remote controlled underwater vehicle, and maneuvering said remote controlled underwater vehicle to a position sufficiently near said anchor means that said lower end of said permanent vertical tethering element and said guide funnel may be observed by said television camera.

9. The method of claim 1, further comprising a step of:

installing additional permanent vertical tethering elements between said platform and said anchor means.

10. The method of claim 9, further comprising steps of:

providing additional guide funnels on said anchor means; and labeling each of said guide funnels so that a proper one of said guide funnels to be engaged by a given one of said permanent vertical tethering elements may be determined by visually observing said guide funnels.

11. The method of claim 10, further comprising steps of:

visually observing said labeled guide funnels by using an underwater television camera; and thereby determining the proper one of said guide funnels to be engaged by the given one of said permanent vertical tethering elements.

12. A system for mooring a floating structure, said system comprising:

anchor means positioned on a floor of said body of water;

means for temporarily mooring said floating structure to said anchor means with a plurality of vertical temporary mooring lines held in tension by a buoyancy of said floating structure;

a vertical permanent tethering element means for connecting said floating structure to said anchor means;

a connector means, attached to said anchor means, for connecting a lower end of said vertical permanent tethering element to said anchor means;

an upward opening guide funnel attached to said anchor means above said connector means, and having an opening therein for guiding said lower end of said vertical permanent tethering element into engagement with said connector means;

means for lowering said vertical permanent tethering element from said floating structure;

a television camera means for observing a location of said lower end of said permanent vertical tethering element relative to said guide funnel; and moving means for moving said lower end of said permanent vertical tethering element laterally, so that said lower end of said permanent vertical tethering element may be positioned above said guide funnel.

13. The system of claim 12, wherein:

said moving means includes a maneuvering means for applying a lateral force to said floating structure.

14. The system of claim 13, wherein:

said maneuvering means includes a tugboat.

15. The system of claim 12, wherein:

said moving means includes thrusting means connected to said vertical permanent tethering element for moving said lower end thereof laterally.

16. The system of claim 12, wherein:

said television camera means is disposed in an inner passage of said vertical permanent tethering element.

17. The system of claim 12, wherein:

said television camera means is attached to a remote controlled vehicle.

18. The system of claim 12, further comprising:

additional guide funnels attached to said anchor means, each of said additional guide funnels including identifying indicia observable by said television camera means.

19. The system of claim 12, wherein:

said anchor means includes a plurality of separate anchor assemblies.

* * * * *

Disclaimer and Dedication 4,352,599.—*Riley Goldsmith,* Houston, Tex. PERMANENT MOORING OF TENSION LEG PLATFORMS. Patent dated Oct. 5, 1982. Disclaimer and Dedication filed Jan. 9, 1984, by the assignee, *Conoco Inc.*

Hereby disclaims and dedicates to the Public the entire remaining term of said patent.

[*Official Gazette April 3, 1984.*]